US005381583A

United States Patent [19]

Thayer et al.

[11] Patent Number: 5,381,583

[45] Date of Patent: Jan. 17, 1995

[54] HIGH VELOCITY AIR AND STATIONARY DISTURBER CLEANER

[75] Inventors: Bruce E. Thayer, Webster; Samuel P. Mordenga, Rochester, both of N.Y.; Billy D. Walcott, Ranchos de Taos, N. Mex.

[73] Assignee: Xerox Corporation, Stamford, N.Y.

[21] Appl. No.: 102,015

[22] Filed: Aug. 4, 1993

Related U.S. Application Data

[62] Division of Ser. No. 805,762, Dec. 12, 1991, Pat. No. 5,291,628.

[51] Int. Cl.[6] ..... A47L 5/34

[52] U.S. Cl. ..... 15/308; 15/398

[58] Field of Search ..... 15/308, 398, 399, 400

[56] References Cited

U.S. PATENT DOCUMENTS 3,060,482 10/1962 Doyle ..... 15/308 X 5,063,635 11/1991 Ishii et al. ..... 15/398

*Primary Examiner*—Christopher K. Moore

*Attorney, Agent, or Firm*—T. L. Fair

[57] ABSTRACT

A high velocity air and stationary disturber cleaner for cleaning surfaces by drawing air under flexible film seals. A vacuum enclosed in a housing provides the suction force to draw the air under the seal, tangent to the surface to be cleaned, thus removing adhered particles. Disturbers are placed on the surface of the seals in contact with the surface to be cleaned to loosen particles to be removed. The brush density, the fiber length and a plastic film incorporated into the brush design are all ways to limit the amount of air flow through the bulk of the brushes for better cleaning efficiency.

1 Claim, 5 Drawing Sheets

HIGH VELOCITY AIR AND STATIONARY DISTURBER CLEANER

This is a division of application Ser. No. 805,762, filed Dec. 12, 1991, now U.S. Pat. No. 5,291,628, issued Mar. 8, 1994.

BACKGROUND OF THE INVENTION

This invention relates generally to electrophotographic printing, and more particularly, concerns cleaning imaging (i.e. photoreceptive, photoconductive, etc.) and bias transfer roll (BTR) surfaces using air velocity.

High velocity air streams have been used to clean photoreceptors in the past. Although several attempts have been made to clean photoreceptors and bias transfer rolls (BTRs), none of these attempts appear to be known to have been used in copiers. These devices, photoreceptors and BTRs, have used air knives to create a high velocity air stream to clean their surfaces. Such devices can consist of a plate, closely spaced to the surface to be cleaned, with narrow slots cut into it. A vacuum is applied behind the plate to cause air to flow through the slots and create a high velocity airstream across the surface being cleaned. The high velocity air flow disturbs the surface boundary layer allowing removal of particles adhered to the surface. The problems with this approach are in the manufacture of the device and the power required to create the vacuum. The tolerances for the cleaner and the surface to be cleaned must be held closely. The orifice slot width must be uniform along its length to maintain uniform air velocities and therefore cleaning. The spacing between the plate and surface to be cleaned must also be uniform for the same reasons. This requires the plate and cleaning surface to be straight, flat and well aligned. If the surface to be cleaned is a roll, the runout of the roll and the parallelism of the roll axis to the slot axis is also important. Because of the close spacing of the cleaning plate to the surface to be cleaned and the narrow orifice slot, the resistance of the system to air flow is very high. As a result of this high resistance to air flow, a considerable air flow is required to generate the required cleaning air velocities needed for the narrow orifice slot to clean the surface. The requirements of high pressure and air flow result in a high power usage for the system and the possibility of a noise problem.

The following disclosures may be relevant to various aspects of the present invention and may be briefly summarized as follows:

U.S. Pat. No. 3,766,593 to Becker et al. discloses an apparatus for cleaning residual particulate material. The apparatus comprises stationary brushes and a brush housing. The stationary brushes are for cleaning residual toner from the surface of a photoconductor. The brush housing is designed so that air flow is at a maximum. A vacuum means is included in the brush housing.

U.S. Pat. No. 3,932,910 to Shimoda discloses a cleaning apparatus for an electrophotographic copying device comprising: (1) a cleaning brush; (2) a casing for the brush wherein the brush is positioned adjacent a first opening so as to contact a work surface; and (3) a means for suction of particles. The cleaning brush is provided for cleaning off particles from a photosensitive surface. A plate which surrounds part of the cleaning brush is provided for introducing air into the casing.

SUMMARY OF INVENTION

Briefly stated, and in accordance with one aspect of the present invention, there is provided an apparatus for cleaning particles from a surface. The apparatus includes a housing, at least one film seal, and a vacuum means. The film seal has one end attached to the housing and the other free end contacts the surface to be cleaned. Vacuum means is connected to the housing to generate air flow, under the film seal, in a direction substantially tangent to the surface at a velocity sufficient to disturb a layer of particles at the boundary between the particles and the surface to remove particles, therefrom.

Pursuant to another aspect of the present invention, there is provided an apparatus for cleaning particles from a surface. The apparatus includes a housing, vacuum means, and a pair of disturber brushes. Vacuum means is connected to the housing, having a vacuum port, to generate air flow in a direction substantially tangent to the surface at a velocity sufficient to disturb a layer of particles at the boundary between the particles and the surface to remove particles, therefrom. A pair of disturber brushes, where one of the pair of disturber brushes is located on one side of the vacuum port of said housing and the other of the pair of disturber brushes being located on the other side of the vacuum port of the housing.

BRIEF DESCRIPTION OF THE DRAWINGS

Other features of the present invention will become apparent as the following description proceeds and upon reference to the drawings, in which:

FIG. 2(A–C) is a schematic of forces applied to toner particles by various cleaners:

3A) shows a plain shim seal with a mounting base;

3B) shows a composite shim seal; and

Figure 4:
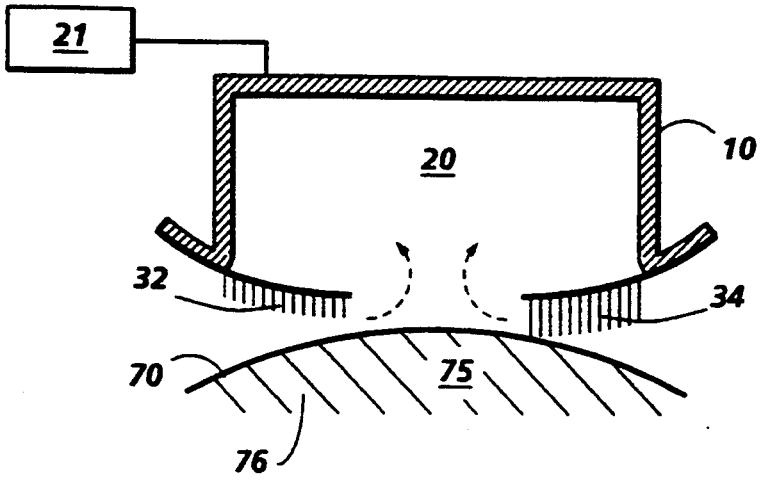
Figure 5:
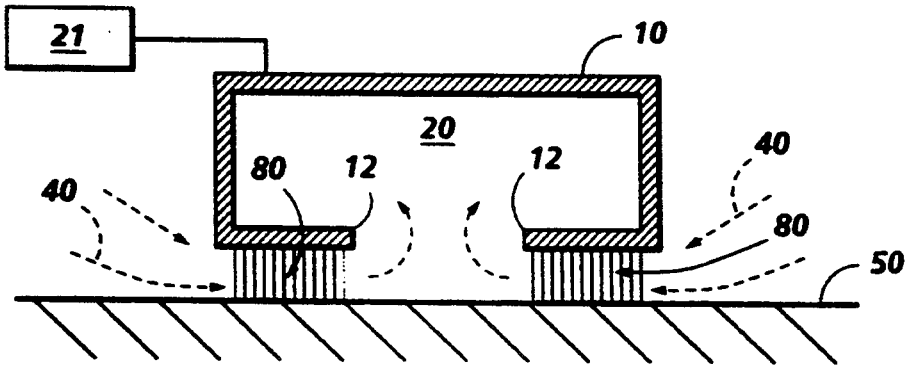

3C) shows another embodiment of a composite seal;

FIG. 4 is a schematic of a short pile disturber for high velocity air flow cleaning;

FIG. 5 is a schematic of air flow through stationary disturber brushes;

FIG. 6(A–C) are schematics of alternate brush designs that use a plastic film to limit air flow through the brush:

6A) shows the plastic film within the disturber brush;

6B) shows the plastic film outside of the vacuum port; and

6C) shows the plastic film inside the vacuum port.

Figure 7:
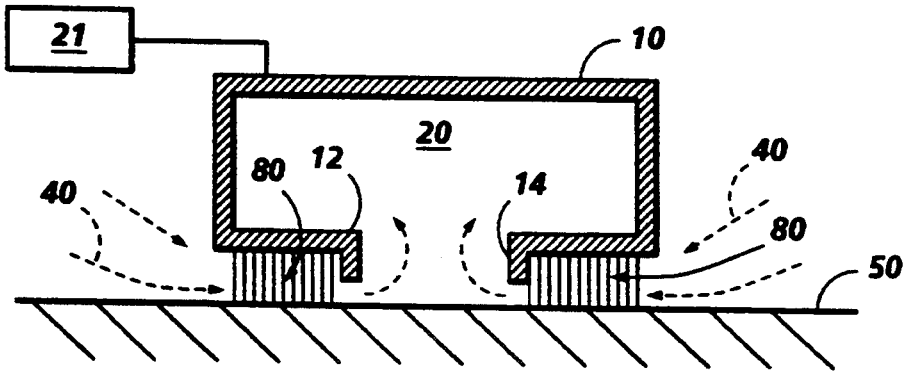

FIG. 7 show a schematic of an alternate housing design with disturber brushes.

Figure 8:
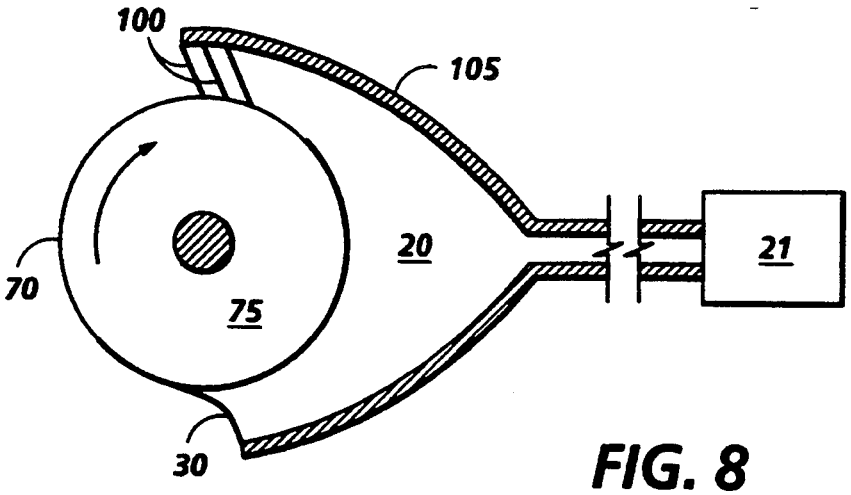

FIG. 8 shows a schematic of a plurality of air foils used to clean a surface.

Figure 9:
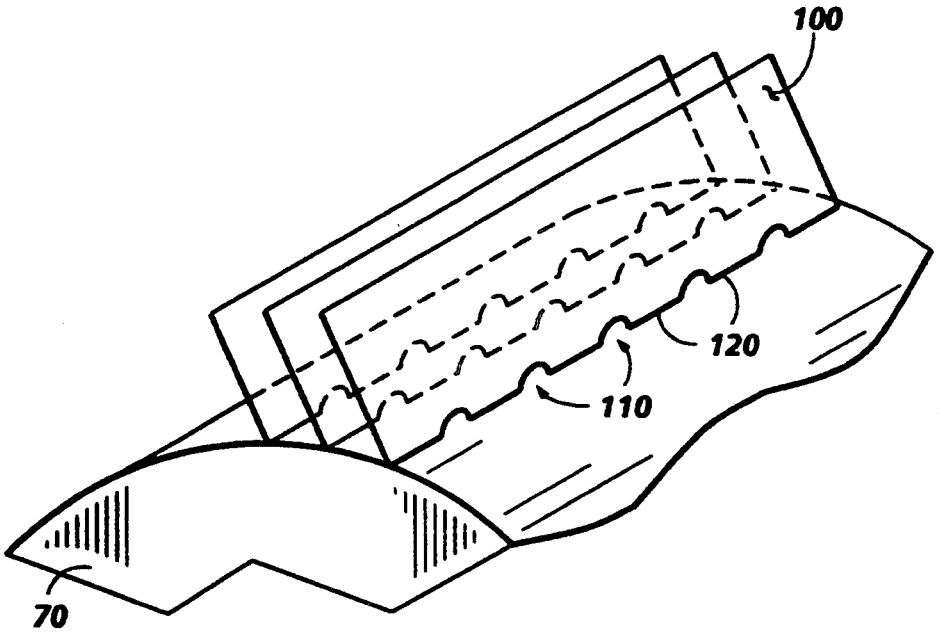

FIG. 9 shows a schematic of the airflow seals or air foils in air flow.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings where the showings are for the purpose of illustrating a preferred embodiment of the invention and not for limiting same.

Figure 1:
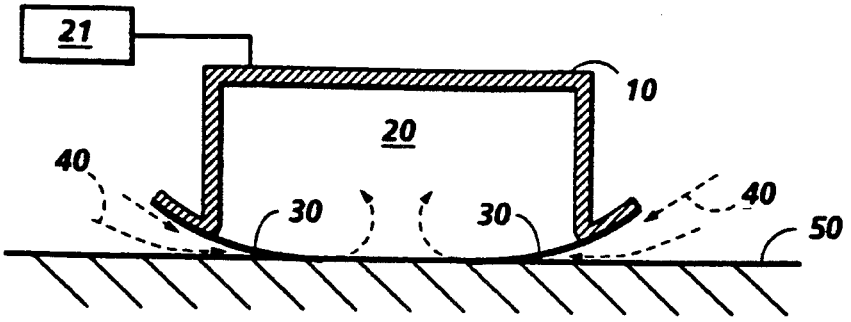
FIG. 1 is a schematic of the housing and flexible seals.

Referring now to FIG. 1, which shows tangential air flow 40, created by a vacuum source (e.g. pump, blower, fan) 21 through housing 10, under the flexible seals 30 in contact with the surface to be cleaned 50. The present invention draws air under flexible film seals 30, by the use of a vacuum 20, created by the vacuum source 21, inside the housing 10, to create the high velocity air needed to disturb the surface boundary layer and remove adhered particles. The film seals 30 are automatically spaced above the surface to be cleaned 50 (i.e. imaging surface or BTR surface) by deflection of the film seals 30 due to the vacuum 20 (i.e. self-spacing). The size of the gap needed for air flow 40 is created by choosing an appropriate stiffness for the flexible seal 30. This can be done by varying the following: the material and thus its elastic modulus; the extended length of the seal; and/or the thickness of the film. With the use of these seals 30, very small gaps can be easily created which will generate high air flows 40 tangent to the surface to be cleaned with relatively small air flows. The very small gaps under the flexible seals 30 insure that the boundary layer is penetrated by the air stream and that the air velocity is high. The air pressures required will be fairly large but not as large as those needed for an air knife since the air flows 40 are much lower. [Bench testing has shown that 425 ft./sec. (129.5 m/sec) air velocity is needed to clean toner from a transfer roll biased to 10 kv.]

Figure 2A:
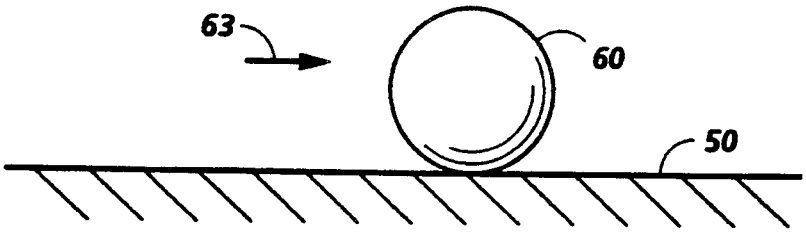
FIG. 2A) shows air flow tangent to the surface.
Figure 2B:
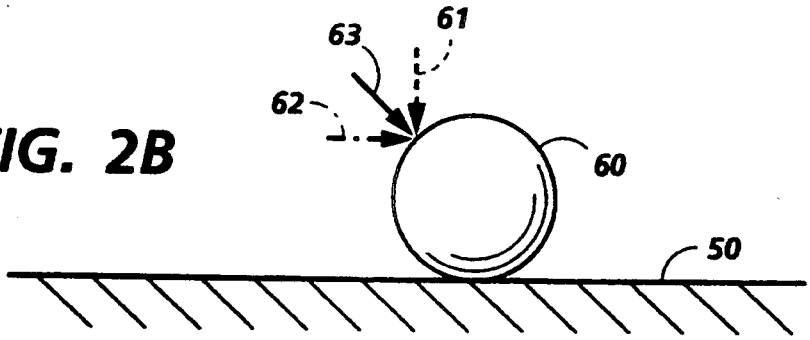
FIG. 2B) shows air flow angled to the surface.
Figure 2C:
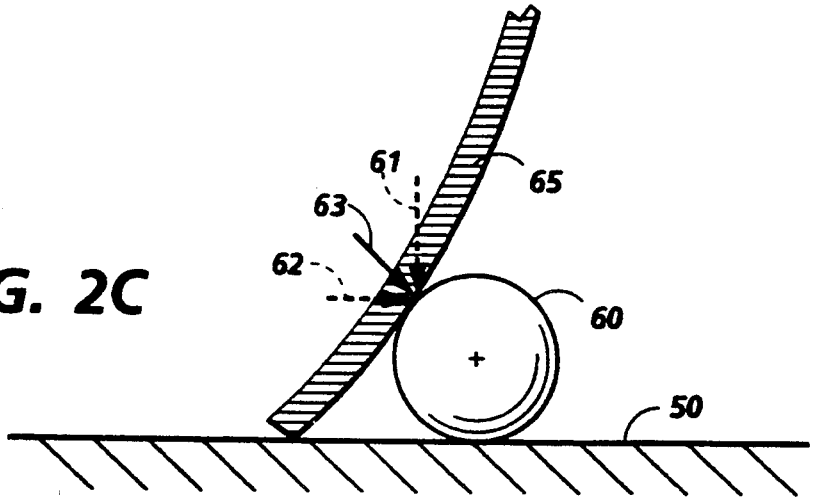
FIG. 2C) shows mechanical force applied by a brush cleaner.

Referring now to FIGS. 2A–2C which shows forces applied to toner particles 60 by various cleaning methods. FIG. 2A shows the present invention, where the applied force 63 works horizontally against the toner particles 60 to remove the particles 60 from the surface 50 to be cleaned. In the present invention the air flow 40, under the flexible seals 30, flows tangent to the surface 50 and thus, less air is needed when compared to an air knife shown in FIG. 2B. In removing particles from the surface 50 a sliding detachment force 62 (see FIG. 2B) is required to dislodge the particles 60 and allow other forces to transport the particles 60 away from the surface 50. In FIG. 2B the applied force 63 can be divided into component forces 61, 62. An air knife, as shown in FIG. 2B, requires high air flows 40 in order to penetrate the boundary layer and generate a large enough tangential air flow component to dislodge particles because only a portion of the force applied by the total air flow is used for the toner detachment force 62. FIG. 2C shows a brush cleaner that uses the brush fibers 65 striking against the particles 60 to dislodge the particles 60 from the surface 50, and then transports the particles 60 away with an air stream. The present invention (shown in FIG. 2A) is advantageous because it more efficiently utilizes the applied force 63. The more efficient use of the applied force is a result of the reduced or lack of the normal force 61 (see FIGS. 2B and 2C) of the present inventions tangential air force design. This more efficient use also decreases the likelihood of the toner being smeared.

The combination of the normal force 61 and the tangential detachment force 62 create the total applied force 63 in FIGS. 2B and 2C. The total applied force 63 in FIG. 2A is a horizontal rather than an angular force due to the air flow under the seals 30 (see FIG. 1) and is tangent to the surface 50 to be cleaned. The total applied force 63 created from the tangential flow forces 62 and normal flow forces 61 (see FIG. 2B) requires more force than the air low that occurs tangentially, as in the present invention (see FIG. 2A).

Figure 3A:
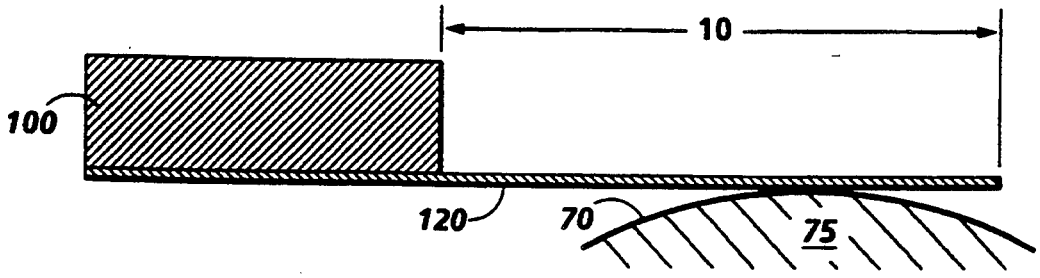
FIG. 3(A–C) shows seal types that successfully meet noise, flow and handling requirements.
Figure 3B:
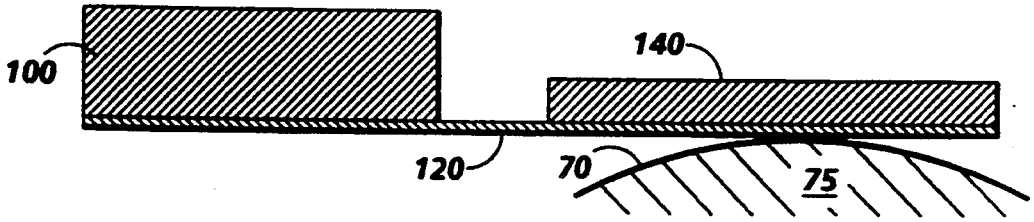
Figure 3C:
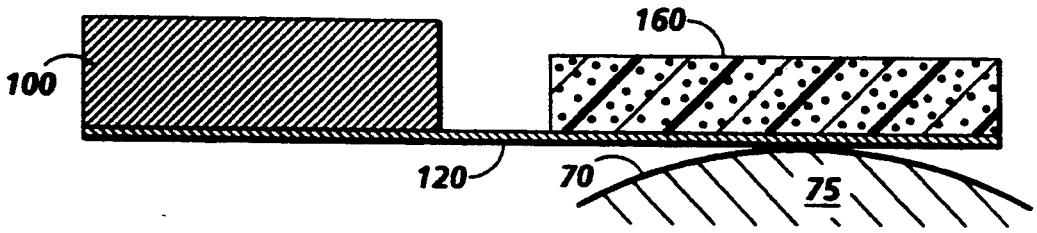

Reference is now made to FIGS. 3A, 3B and 3C. The design of the seals 30 (see FIG. 1) have three major requirements. First, is low pressure on the surface to be cleaned to allow adequate air flow under the seal. Second is a material of either high stiffness or soft, to prevent the seal from acting as a reed and generating highly objectionable noise. And third, is high enough stiffness and strength to withstand vacuum pressure, a moving surface and handling in assembly. Testing with mylar seals has shown that a simple seal of this type of material will probably not work well. If a thin shim of mylar is used, very loud noise is generated. Thicker mylar shims do not generate noise but the air flow is significantly reduced.

With continued reference to FIGS. 3 (A–C), three seal types are shown that have successfully met the noise, flow and handling requirements described above. FIG. 3A shows a plain shim seal 120, that has a mounting base 100. The shim thickness range of this mylar shown is 0.005" (0.013 cm) to 0.0075" (0.019 cm). FIG. 3B shows a composite shim seal. The mounting base 100 is adhered to a mylar shim ranging in thickness between 0.003" (0.008 cm) to 0.0075" (0.019 cm). A stiffener is applied to the opposite end of the shim 120 from the mounting base 100 in the form of thick shim 140. The thin shim 120 with the thick shim 140 attached contacts the surface 70 of the BTR 75. FIG. 3C also shows a composite shim seal but instead of attaching thick shim to the thin shim 120, opposite the side of the thin shim 120 contacting the BTR surface 70, foam 160 is attached. The thin shim 120 thickness ranges from 0.002" (0.005 cm) to 0.0075" (0.019 cm). The following example discusses the observations made during testing of these seal design variations shown in FIG. 3. (Note: All of the shim materials tested consisted of mylar shim stock glued to the mounting base with double back tape.)

EXAMPLE I

The first experimental observation was that the seals made from plastic shim stock can act as reeds and generate extremely objectionable amounts of noise. The thicker the seal, the higher the frequency of the noise. As thicker shim stock was used, the frequency was increased and eventually the noise was eliminated. The noise can also be eliminated by shortening the extended length of the seal. Either of these approaches increases the stiffness of the seal to increase the natural frequency of the beam. Increasing the seal stiffness also decrease the gap between the roll and the seal for air to flow through. If too thick a seal [0.0075" (0.019 cm)] is used, no air will flow under the seal. With too little air, even though the air velocity may be high poor cleaning results. This is due in part to the low flow and also probably to the nonuniform distribution of air flow. Another remedy to the noise problem is to use a thin shim with a thick shim attached (taped) to the end. See FIG. 3B. This allows the thin shim to be a hinge and provide low stiffness while the thick end provides extra mass and its stiffness prevents the length of the seal from vibrating.

A more flexible seal can be created by using a thin shim and attaching a layer of foam material to the back of the shim. See FIG. 3C. This type of seal allowed more air flow and experienced no noise problems. For very thin shims [0.002" (0.005 cm)] the seal was pulled away from the BTR by the foam end seals and wrinkles were observed in the seal causing nonuniform air flow. Thicker shims [0.003" (0.008)] did not experience this problem.

All of the testing performed to date has been on the cleaning of BTRs. As a BTR cleaner this cleaner is required to remove high density toner from the roll surface. In order to clean the transferred images and untransferred patches seen by a P/R cleaner some changes in seal stiffness and air flow may need to be made. There is, however, no reason to believe that the type of cleaner described in this invention proposal could not be utilized for cleaning photoreceptors as well as cleaning BTRs.

Referring now to FIG. 4, which shows a short pile disturber for high velocity air flow cleaning. The housing 10 encloses a vacuum 20, created by a vacuum source 21 connected to the housing 10 and a flexible seal 30 is attached to either side of the housing 10. In the figure, the "upstream" and "downstream" sides refer to the left and right sides of the housing, respectively. The upstream side of the the cleaning process is analogous to preclean, whereas the downstream side is analogous to postclean in the cleaning process. However, with respect to the BTR cleaning seals, preclean and postclean do not apply since the BTR seals are the cleaning elements.

With continued reference to FIG. 4, on the upstream side of the housing 10, the surface of the film seal 30 that contacts the BTR surface 70, has a Corduroy fabric disturber 32 attached thereto. On the opposite side, (i.e. the downstream side) of the housing 10 the disturber material is a Velour fabric 34 that contacts the BTR surface 70 in a similar fashion as the Corduroy fabric 32. [Note: The disturber materials are not limited to Corduroy and Velour. Any cotton, polyester or nylon material that will sufficiently disturb particles on the surface (i.e. imaging or BTR surface) can be used as a disturber material in the present invention.]

The addition of a disturber (Corduroy 32 and/or Velour 34) to the seals 30 allows lower air flows to be used to clean the surface 70. This is because the disturber (32, 34) will dislodge toner from the surface 70 so that it is more easily removed by the air flow and/or the disruption of the air flow path by the disturber (32, 34) causes the air velocities locally to be higher than the average air flow resulting in cleaning by air. The disturber (32,34) proposed here consists of a short pile fabric attached to the seal 30. The short fibers act as the disturber elements causing toner to be dislodged and creating more turbulence and higher air velocities in the vicinity of the fiber tips. The pile height must be short enough to keep the air flow close to the cleaning surface. The pile density must be high enough to provide enough to provide enough fibers in contact with the cleaning surface to efficiently disturb the toner. If the pile height or density is too high toner will accumulate in the fabric and cause spots on copies when large agglomerations of toner fall out of the fabric.

EXAMPLE II

Testing was performed with several types of pile fabrics. Some of the fabrics tried were velours, velcro hooks, velcro loop piles and Corduroy fabric. The most successful test involved Corduroy fabric mounted to a 0.004" (0.010 cm) plastic shim on the upstream side of the cleaner and Velour fabric mounted to a 0.005" (0.013 cm) plastic shim on the downstream side. (See FIG. 4.)

The Corduroy/Velour combination of fabric disturbers kept the BTR relatively clean and thus, the backs of the photocopies were also very clean. The stress to the BTR cleaner occurs when the toner is transferred to the BTR from the photoreceptor belt seam. This transference leaves a vertical stripe on the back of every seventh copy when using a seven pitch machine. Depending on the efficiency of the cleaning of the BTR, the stripe will be darker or fainter. In many cases the stripe was reprinted several times on successive copy sheets. The Corduroy/Velour disturbers completely eliminated this stripe from the back of the copies. A similar result was also observed when the cleaner was stressed by developing an approximately 10 mm wide black vertical stripe in every interdocument zone. The air flow used by the cleaner was scaled up to a full width BTR [~15" (38.1 cm)] resulting in 15 cfm (cubic feet per minute) at 29 in. (73.66 cm) $H_2O$. This air requirement is expected to be reduced as the disturbers are optimized. (The air flow is sufficient for cleaning but not high enough to remove toner from the cleaner housing and transport toner through the hoses.)

Referring now to FIG. 5 which shows a high velocity air and stationary disturber brush cleaner. A vacuum 20, created by a vacuum source 21, enclosed in a housing 10, provides the force necessary to draw the air flow 40 through a pair of stationary fiber brushes 80, one on either side of the vacuum port 12. The brushes 80 disturb the particles adhered to the surface 50 to be cleaned and increase the turbulence of the air flow 40 at the cleaning surface 50. The air flow 40 aids in removing particles from the surface 50 and transports the cleaned particles away from the cleaning surface 50.

Figure 6A:
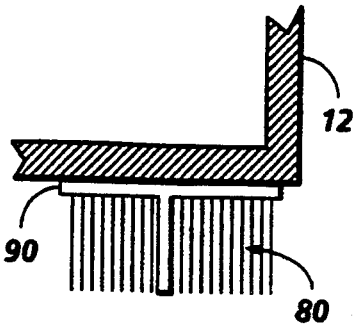
Figure 6B:
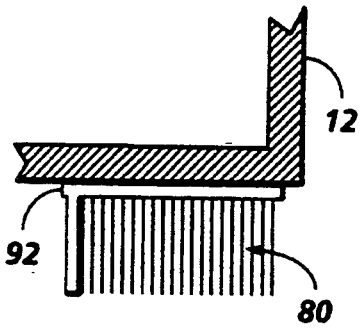
Figure 6C:
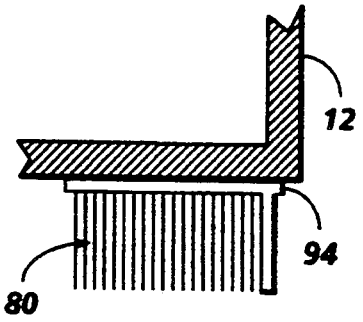

Referring now to FIG. 6(A–C) which shows alternate brush designs using plastic film to limit air flow through the stationary brush 80, FIG. 6A shows a plastic film within 90 the stationary brush 80. FIG. 6B shows a plastic film outside 92 the vacuum port 12. FIG. 6C shows a plastic film inside 94 the vacuum port 12.

These alternate brush designs require special cleaner design considerations. Testing has shown that the brushes need to be spaced near to the vacuum port 12. If the brushes are too far from the vacuum port 12, the result is poorer cleaning. If the brushes are too close, however, the brush fibers will be sucked together across the vacuum port and restrict the air flow through the device. A trade-off between brush stiffness and spacing to the vacuum port 12 must be determined. The interference of the brushes 80 to the surface to be cleaned has been found to be critical. Poorer cleaning of the surface was experienced with both high and low interferences. An optimum brush interference does exist and must be determined for the brushes 80 being used. The brush density must be high enough to prevent significant air flow through the bulk of the brush, but away from the surface to be cleaned. For the same reason the brush fiber length must be kept short enough to minimize the level of the air flow through the bulk of the brushes 80. (The brush fibers range in length from about 3 mm to about 15 mm. Thee ideal brush fibers length is about 5 mm to about 10 mm.) In order to limit the amount of air flow through the bulk of the brushes 80 a plastic film (90, 92, 94) can be incorporated into the brush design. This plastic film can be within 90 the brush 80 or inside 94 or outside 92 of the vacuum port 12.

An alternate design to the plastic film on the inside 94 (see FIG. 6C) of the vacuum port 12 is shown in FIG. 7. In this figure, a vacuum source 21 through the housing 10 creates a vacuum 20. The vacuum port 12 has housing extensions 14 on either side of the housing 10, on the inside of the vacuum port 12, that stop short of contacting the surface 50 to be cleaned. Thus, the air flow 40 can still be drawn through the stationary brush 80 fibers by the force created by the vacuum. The housing 10 design shown in this figure (i.e. the housing extensions 14) was created to eliminate concern involving the brush 80 closing off the vacuum port 12.

Another concern was for the accumulation of toner within the brushes 80. Decreasing the length of the brush fibers, can serve to lessen this concern. To eliminate this concern entirely, the air flow through the cleaner must be high enough to keep the fibers clean.

EXAMPLE III

Tests were conducted on a three inch (7.62 cm) long bias transfer roll biased to 5000 v. Toner was developed onto the bias transfer roll by a 1065 copier developer run against the roll. The air flow requirements for this cleaner scaled up to a 15 inch (38.1 cm) bias transfer roll were 142 cfm and 18.7 inches (47.5 cm) of water. Because the stationary disturber brush cleaner has no moving parts at the cleaner and the drag against the bias transfer roll is very near zero essentially all of the power required is for the air system. For a full length bias transfer roll the power required would be 312 watts. These values are based on the bench tested device which would presumably be improved through design optimization.

Referring now to FIGS. 8 and 9, which shows an alternative method of cleaning a BTR 75. A plurality of air foils 100 are constructed within a housing or chamber 105 with suction applied by a blower. The foils 100 are of a compliant material (i.e. mylar) and cut with a series of gaps or apertures 110 and flats 120. The flats 120 ride on the BTR surface 70 and act as toner disturbers. Air is drawn through the gaps 120 creating turbulence and the vacuum suction inside the housing 105 draws the disturbed toner off of the BTR 75 and deposits it into a waste filter. The foils 100 are staggered so that the flats 120 contact the entire BTR surface 70 width wise. The foils 100 are spaced in a parallel manner to one another to produce maximum air turbulence. The enclosure surrounding the foils is sealed on the ends in that, the air foils 100 seal one end of the housing 105 and the opposite end is sealed by an air seal 30 that is attached to the housing or chamber 105 on one end and held in tangential contact with the BTR surface 70 on the other end of the seal 30 by the suction from the vacuum. The advantages of this system over the conventional flap seals are that the flats 120 cause toner disturbance making it easier to remove the toner, and the gaps 110 create air turbulence which helps to prevent toner redeposition on the roll, and facilitates toner transport through the system to the filter. The advantages over a rotating brush system are found in cost and the fact that no mechanical drive system is needed for this invention.

In recapitulation, it is evident that the air knife cleaner of the present invention is a high velocity air and stationary disturber cleaner. The present invention draws air under flexible seals or air foils at a high velocity to disturb the surface boundary layer and remove adhered particles from the surface to be cleaned. Additionally, the present invention, through the use of disturbers, on the flexible seals reduces the velocity of the air needed to clean the surface. The present invention also provides a plastic film in the stationary brushes, when they are used as disturbers, to prevent the brushes from being sucked into the vacuum enclosed in the housing and to minimize the level of air flow through the bulk of the brushes.

It is, therefore, apparent that there has been provided in accordance with the present invention, a high velocity air and stationary disturber cleaner, that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for cleaning particles from a surface, comprising:

a housing, having a vacuum port;

vacuum means, connected to said housing, for generating air flow in a direction substantially tangential to the surface at a velocity sufficient to disturb a layer of particles at the boundary between the particles and the surface to remove particles, therefrom; and a pair of disturber brushes, each of said pair of disturber brushes including a multiplicity of substantially flexible fibers, one of said pair of disturber brushes being located on one side of the vacuum port of said housing and the other of said pair of disturber brushes being located on the other side of the vacuum port of said housing, and a plastic film interposed in the fibers for reducing air flow therethrough.

* * * * *